US007127995B2

(12) United States Patent
Ronn et al.

(10) Patent No.: US 7,127,995 B2
(45) **Date of Patent: *Oct. 31, 2006**

(54) DEVICE FOR ADAPTING A UNIT OF AMMUNITION FOR DIFFERENT TYPES OF TARGETS AND SITUATIONS

(75) Inventors: Torsten Ronn, Karlskoga (SE); Nils Johansson, Karlskoga (SE)

(73) Assignee: BAE Systems Bofors AB(SE)

( * ) Notice: Subject to any disclaimer, the term of this patent is extended or adjusted under 35 U.S.C. 154(b) by 162 days.

This patent is subject to a terminal disclaimer.

(21) Appl. No.: 10/332,008

(22) PCT Filed: Jun. 20, 2001

(86) PCT No.: PCT/SE01/01401

§ 371 (c)(1),
(2), (4) Date: Mar. 31, 2003

(87) PCT Pub. No.: WO02/03015

PCT Pub. Date: Jan. 10, 2002

(65) Prior Publication Data

US 2003/0172833 A1 Sep. 18, 2003

(30) Foreign Application Priority Data

Jul. 3, 2000 (SE) ..... 0002492-7

(51) Int. Cl.
*F42B 12/22* (2006.01)
*F42B 12/58* (2006.01)

(52) U.S. Cl. ..... 102/506

(58) Field of Classification Search ..... 102/504, 102/506, 473, 492, 494; 89/1, 808; *F42B 12/58*
See application file for complete search history.

(56) References Cited

U.S. PATENT DOCUMENTS 3,500,714 A * 3/1970 Cullinane ..... 89/1.1

(Continued)

FOREIGN PATENT DOCUMENTS

DE 3920016 A1 * 1/1991

(Continued)

*Primary Examiner*—Michael J. Carone
*Assistant Examiner*—Susan C. Alimenti
(74) *Attorney, Agent, or Firm*—Connolly Bove Lodge & Hutz, LLP; Larry J. Hume

(57) ABSTRACT

An ammunition unit (1) designed to he adaptable to different types of targets (2,2') or situations. The said ammunition unit comprises cylindrical warhead charges (4, 5) that confine or form explosive compositions (23), on or around the outside of which there are effect layers or casing containing effect elements (25, 27). These effect elements together with the explosive compositions (24) constitute the combatant function. Two or more cylindrical warhead charges (4, 5) are arranged essentially parallel alongside each other or inside each other. Each of the cylindrical warhead charges comprises effect layers around their cylindrical outer surface that provide different effects in target. The cylindrical warhead charges are rotatably arranged to assume different rotational setting modes, and in each such mode the same type or co-ordinated types of effect layers are directed outwards.

14 Claims, 4 Drawing Sheets

U.S. PATENT DOCUMENTS

Figure 1:
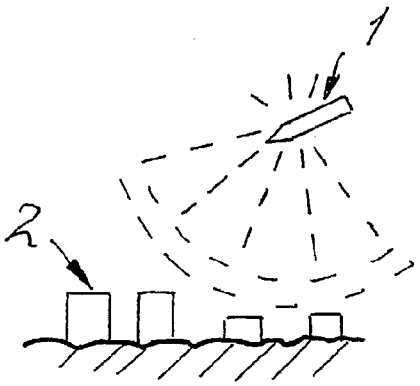

| | | | | | |
|---|---|---|---|---|---|
| 5,817,969 | A | * | 10/1998 | Ettmuller | 102/489 |
| 3,646,888 | A | * | 3/1972 | Posson et al. | 102/496 |
| 3,750,587 | A | * | 8/1973 | Walde | 102/496 |
| 3,818,833 | A | * | 6/1974 | Throner, Jr. | 102/389 |
| 3,960,085 | A | | 6/1976 | Abernathy et al. | |
| 3,974,771 | A | | 8/1976 | Thomanek | |
| 4,644,867 | A | * | 2/1987 | Hellner et al. | 102/495 |
| 5,094,170 | A | | 3/1992 | Raynaud et al. | |

FOREIGN PATENT DOCUMENTS

| | | | | |
|---|---|---|---|---|
| EP | 0108741 | A1 | | 5/1984 |
| GB | 253867 | | | 4/1926 |
| GB | 2251480 | A | * | 7/1992 |
| JP | 2002062099 | A | * | 2/2002 |
| WO | WO 200203016 | A | * | 7/2000 |
| WO | WO 200203017 | A | * | 7/2000 |

* cited by examiner

DEVICE FOR ADAPTING A UNIT OF AMMUNITION FOR DIFFERENT TYPES OF TARGETS AND SITUATIONS

The present invention relates to a device for adapting a unit of ammunition for different types of targets or engagement situations. 'Ammunition unit' herein denotes roll-stabilised missiles, cruise missiles, anti-tank rounds, etc. As claimed in the present invention the ammunition unit shall contain cylindrical explosive parts, hereinafter called warhead charges, encapsulating explosive compositions, on or around the surface of which there is a warhead effect layer comprised of effect elements in the form of, for example, pellets, fragments, incendiary agents, etc. The warhead effect elements together with the explosive compositions constitute the combatant function.

Arranging warhead charges in the said types of ammunition units is already known, whereby each warhead charge can be constructed for use against a specific type of target by employing explosives, warheads With pellets, fragments, etc. This means that different types of warhead charges must be used for different types of targets, which means that a relatively large assortment of ammunition must be available in the vicinity when engaging different types of targets. General reference can be made to the general technology applied in this field and to the patent literature in this technological field.

There is a distinct desire to be able to reduce the assortment of ammunition, which—to comply with the above requirements—means that one and the same ammunition unit must be designed to effectively engage different types of targets and situations. Despite the enhanced requirement for engaging a number of different types of targets with the same ammunition unit this desired capability must not impose constraints on the ammunition unit's other functions; instead, the technical-financial requirements gained through the proposed measures must be attainable without the ammunition unit or its functions being made more complex or expensive in other respects. The main objective of the present invention is to resolve this problem among other things.

In some contexts it is also relevant to be able to effect different warhead functions in different directions, thus relating to a roll-stabilised ammunition unit such as a missile. It is intended that the present invention should also resolve this problem.

The main characteristic features of the device mentioned in the introduction are that the cylindrical or otherwise rotationally symmetrical warhead charges are arranged essentially parallel alongside each other or inside each other, and that the outer wall of each of the cylindrical warhead charges incorporates or interacts with different effect layers to provide different effects in the target. Additional features are that the cylindrical warhead charges are rotatably arranged to assume various angles of rotation, and that the charges are also arranged to assume different setting modes so that in each mode the same type of, or coordinate types of, effect layers in the charges face outwards when viewed from the outside of the ammunition unit. Adjustment to different types of targets can thereby be effected by setting the warhead charges to the appropriate mode.

The device in the present invention can be considered to be characterised by the fact that a warhead charge is designed and that an explosive composition is arranged inside the warhead charge to be rotatable relative to the tubular warhead charge between various angles of rotation positions. Another characteristic is that the tubular warhead charge is arranged with a first effect layer extending around an arc of the cylindrical surface of the warhead charge when viewed through a cross-section of the charge (cf. the cross-sections illustrated in FIGS. 8 and 9). Another characteristic feature is that between the tubular warhead charge and the explosive composition there is a second effect layer arranged extending around an arc of the inner surface of the tubular warhead charge and the outer surface of the explosive composition, and at the first angle of rotation position the two effect layers are directed essentially away from each other (in diametrically opposed directions) and in the second angle of rotation position the two effect layers overlap each other completely, i.e. they are directed in the same direction. Adjustment to different types of targets even in this case is via the setting of the respective angle of rotation positions.

In a preferred design the rotational motion of the warhead charges is co-ordinated. The rotation device can be arranged to effect each setting position by using one or more guides.

The rotation device can be controllable from ground-based equipment via wire or wireless communication. Alternatively the rotation device can be adjustable on the ground via a manually actuated arrangement or actuation device.

In another design version of the invention concept, in the first setting mode position of rotation of the warhead charge a first effect layer with large pellets or fragments is directed outwards, while in a second setting mode position of rotation a second effect layer with smaller pellets or fragments is directed outwards instead. Moreover, a first effect layer can comprise pellets or fragments of some kind, while a second effect layer can be free of effect elements to enable the warhead charge to exert pressure effect. The effect layer in question can also, or alternatively, comprise incendiary elements or some other type of element.

In the version with mutually parallel cylindrical warhead charges they are rotated and journalled at one or both ends by means of the said rotation device. In the version with two cylindrical warhead charges arranged inside each other they can operate with a first setting position where both charges display an effect layer with pellets or fragments directed outwards, and a second setting position where the arcs free of effect elements are located in a first direction and the arcs with effect elements are directed in a joint direction that is opposite to the first mentioned direction. Such an arrangement has special advantages for an ammunition unit that is roll-stabilised such as a missile. The ammunition unit can thereby be released or activated with either the effect layers free of effect elements directed at the target, or with the effect layers comprising effect elements directed at the target. In a third attack option there can thus be an effect layer with effect elements all around the circumference of the warhead charge. In a preferred design version each warhead charge displays two or more different effect layers around its circumference. In the version with two different effect layers, each effect layer occupies approximately half the circumference. In the design version with two warhead charges arranged rotatably inside each other the main explosive charge is located inside the outermost charge and is rotatable in the outermost charge.

The above proposals enable a number of advantages. The target adaptation function opens the way for technical-financial benefits. The target adaptation function can be remotely operated via a wire or wireless link. A wide choice of options can be achieved when constructing the warhead charges and their effect layers or casing.

Figure 2:
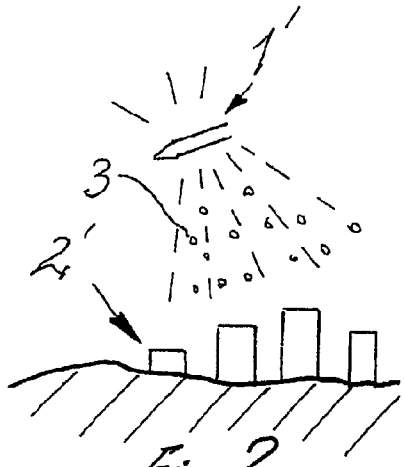
Figure 3:
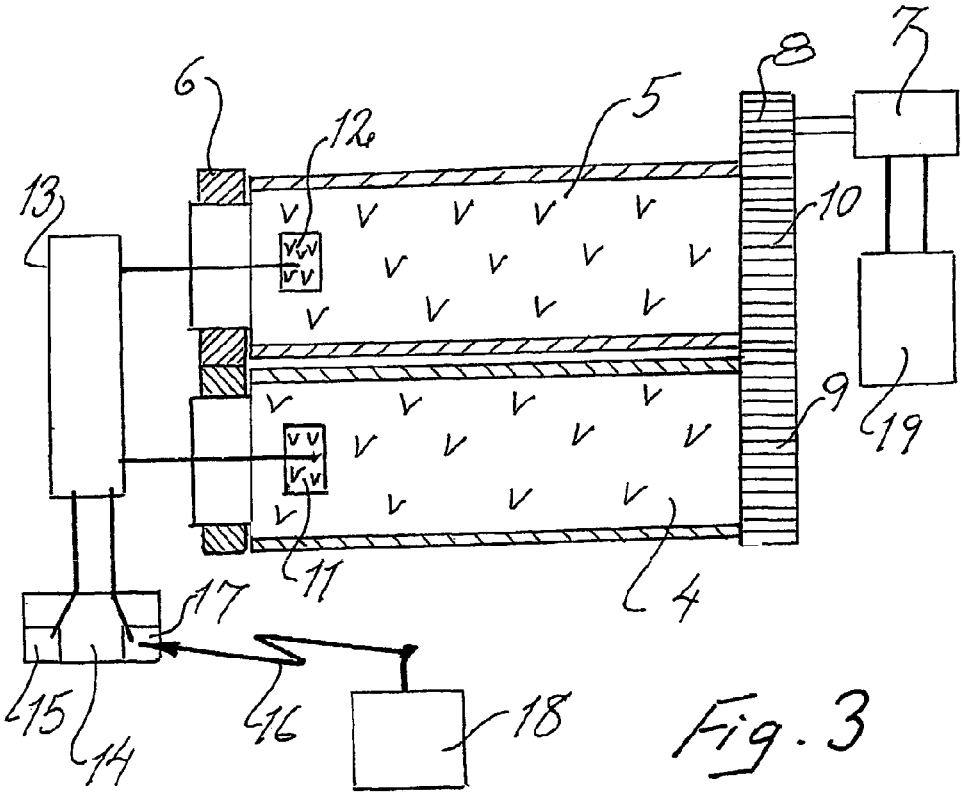
Figure 4:
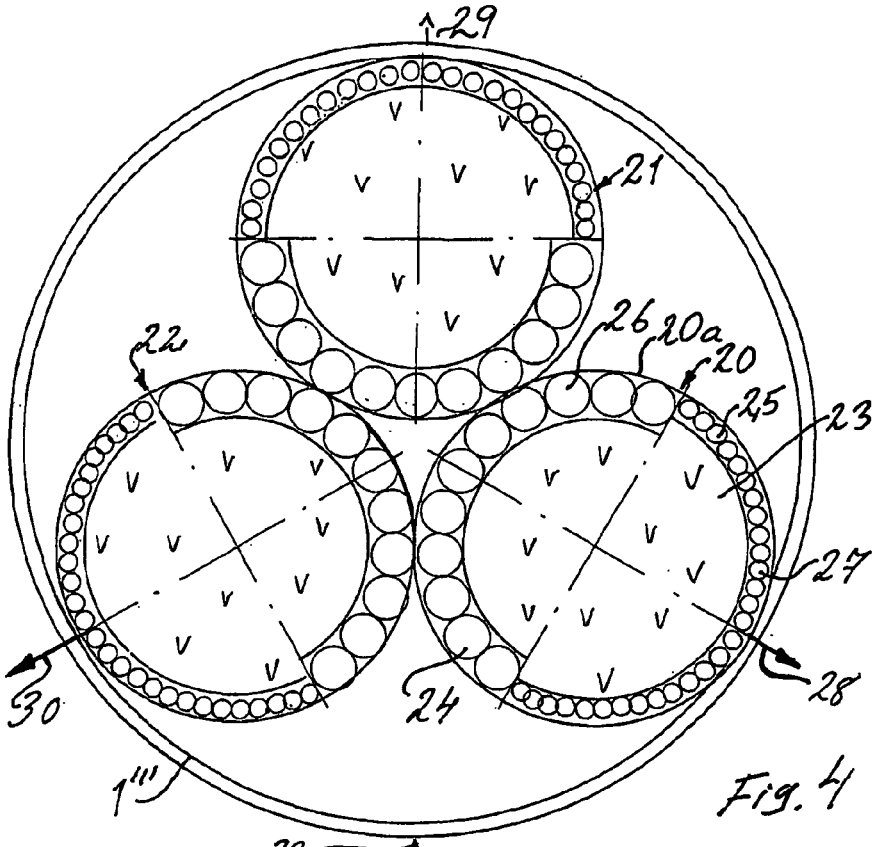
Figure 5:
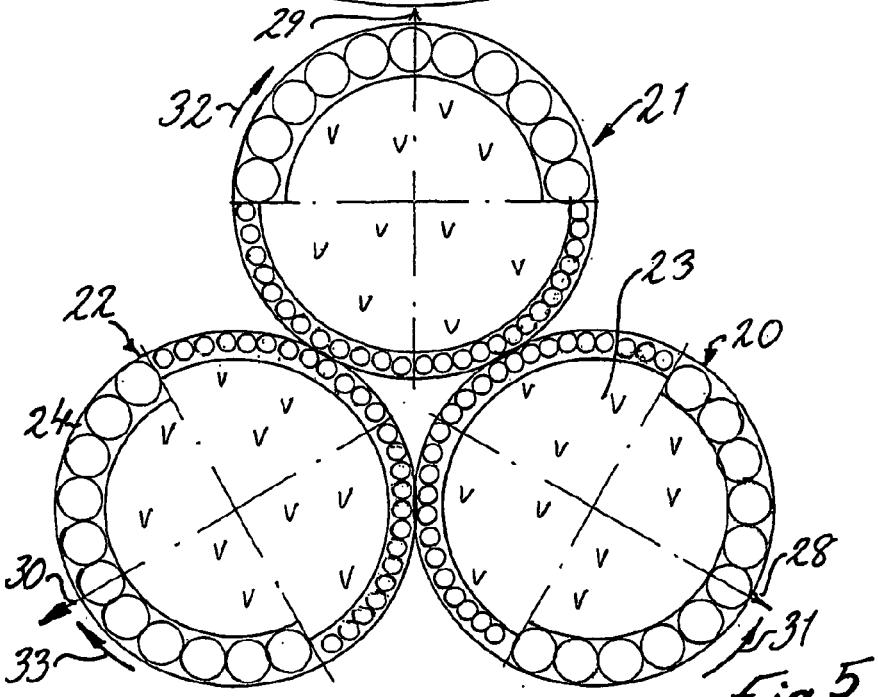
Figure 6:
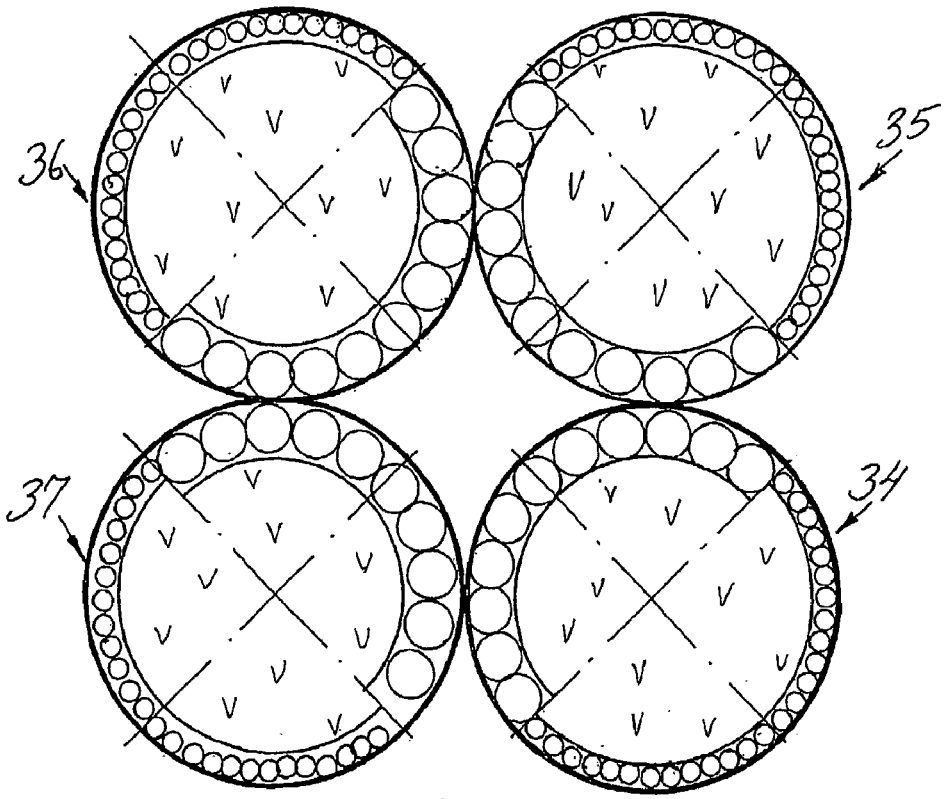
Figure 7:
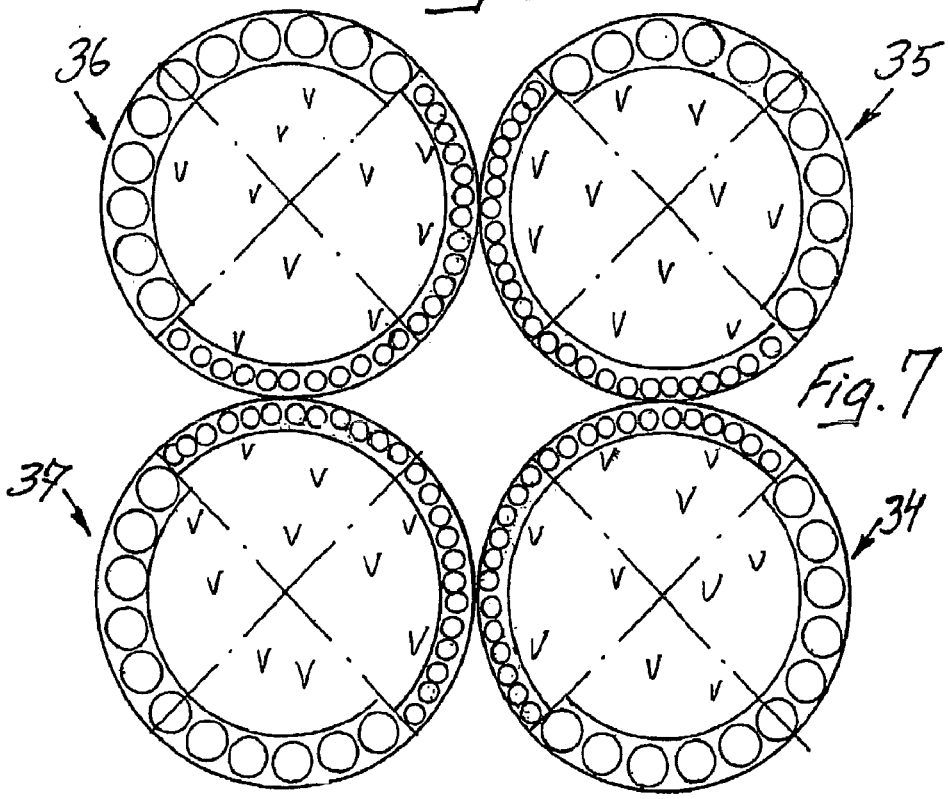
Figure 8:
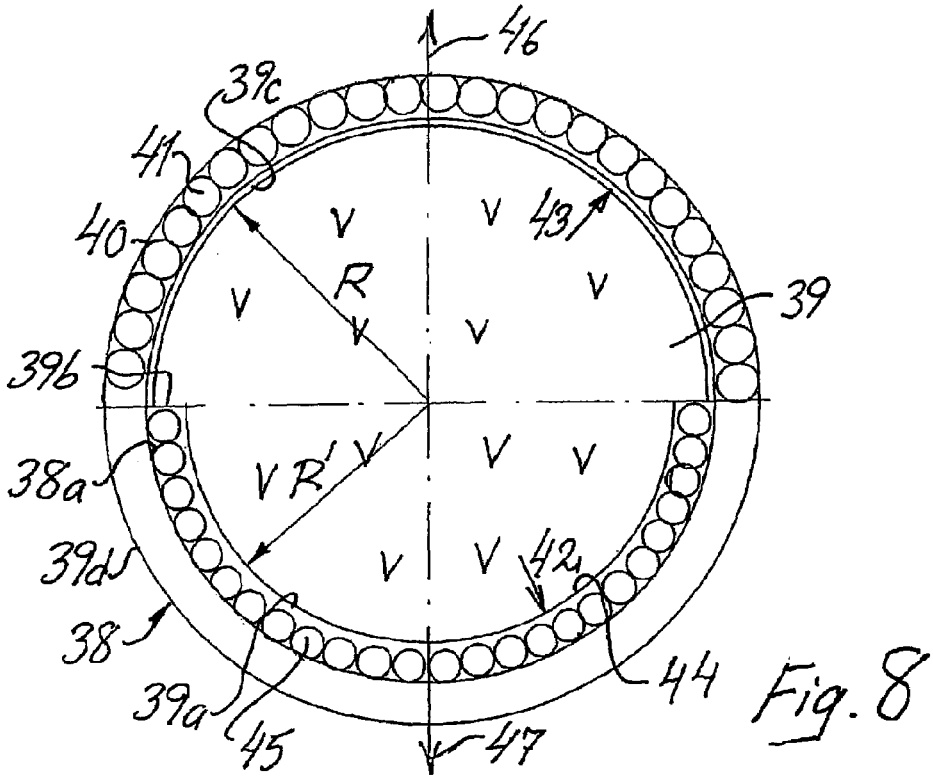
Figure 9:
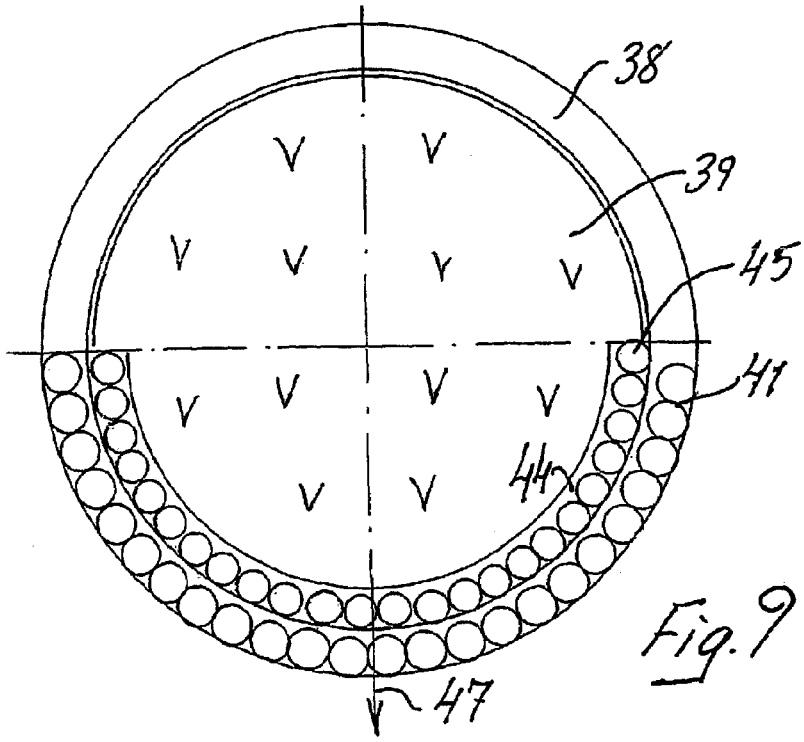

A currently proposed design for a device as claimed in the present invention is described below with reference to the appended FIGS. 1–9 in which FIG. 1 shows a general overview of a burst in the vicinity of a first target type, FIG. 2 shows a general overview of a burst from an ammunition unit in the vicinity of a second target type, FIG. 3 is a vertical section partially illustrating parts of warhead charges arranged in an ammunition unit where the charges are arranged to be mutually rotatable to different angles of rotation positions that serve as setting mode positions for the charges, FIG. 4 is a cross-sectional end view of an arrangement with three cylindrical warhead charges arranged alongside each other in a first setting mode position, FIG. 5 is a cross-sectional end view showing the warhead charges illustrated in FIG. 4 in a second setting mode position, FIG. 6 is a cross-section showing an arrangement with four cylindrical warhead charges arranged in a first setting mode position, FIG. 7 is a cross-section showing the cylindrical warhead charges illustrated in FIG. 6 in a second setting mode position, FIG. 8 is a cross-section showing a design with two cylindrical warhead charges where one comprises an outer cylinder and the other an inner cylinder whereby the two warhead charges assume a first mutual setting mode position, and FIG. 9 is a cross-sectional end view showing the two warhead charges illustrated in FIG. 8, but where they have assumed a second setting mode position.

Number 1 in FIG. 1 denotes an ammunition cargo unit, for example in the form of a missile. The ammunition unit in question is set to engage a target of a first type denoted 2. The combatant function in question is for combating the target using purely pressure effect.

In the case illustrated in FIG. 2 ammunition unit 1' is engaging a target 2' of a different type. The combatant function in this case is designed to use the said pressure effect in combination with pellets or fragments 3.

In FIG. 3 a number of cylindrical warhead charges are arranged in an ammunition unit 1". The Figure illustrates two warhead charges denoted 4 and 5. In addition to their cylindrical form shown in cross-section the longitudinal form of the warhead charges is also shown (in landscape format in FIG. 3). The warhead charges are journalled at one end at least, in journal devices 6. At their other end the warhead charges are actuated by rotation device 7, which can consist of an electric motor or manual actuating device, etc. Motor actuation is via its driver 8 acting on cogs or gear rings 9 and 10 located on the said warhead charges 4 and 5. Moreover, warhead charges 4 and 5 are equipped with initiation or detonation devices generally indicated by 11 and 12. The said devices 11 and 12 can be triggered from a trigger unit 13 of a type already known. The trigger unit can be equipped with the mode setting device 14 that can be actuated via a manual control 15 or via a wireless link 16 via a receiver 17. The missile can be triggered either by the control devices in units 13 and 14 or by a trigger signal received via the wireless link 16 from a unit 18 on the ground. In the case of an electric motor for setting the angle of rotation positions for warhead charges 4 and 5 the ammunition unit 1" can incorporate a control unit 19 to actuate the motor 7. Even 19 can be controlled by time circuits or from the ground via wireless link (cf. 16 and 18). The ammunition unit can thus have a first setting mode at the beginning of its trajectory or flight path, but if the target or type of target changes while the ammunition unit is in flight towards the target, or if the ammunition unit 1" shall be re-directed at a different target while in flight, adjustment to an alternative setting mode can be effected to achieve an effective target kill even in this case.

The motor illustrated in FIG. 3 enables two setting modes to be effected in the case illustrated in FIGS. 4 and 5. The first setting mode is illustrated in FIG. 4. Three warhead charges are arranged in parallel alongside each other, located with their longitudinal axes at right angles to the cross-section shown in FIG. 4. In the present design example the individual cylindrical warhead charges 20, 21 and 22 are essentially constructed in the same way, and so only one warhead charge will be described in detail herein. Warhead charge 20 contains an explosive composition inside of already known type. Effect layers 24 and 25 are arranged outside the explosive composition, i.e. adjacent to the periphery 20*a* of the ammunition unit 20. The first effect layer 24 comprises pellets 26 of a large dimension, and effect layer 25 comprises pellets 27 of a small dimension. Each effect layer extends along half the periphery of warhead charge 20. In the setting mode illustrated in FIG. 1 the effect layer 25 is directed outwards, i.e. in the directions of arrows 28, 29 and 30. This means that the warhead function triggered in ammunition unit 1'" will comprise mainly pressure effect from explosive compositions 23 combined with the effect from pellets 27 of small dimension.

By means of the manual or electrical rotation of the cylindrical warhead charges 20, 21 and 22 by one half of a revolution the charges in question will assume the second setting mode illustrated in FIG. 5. The rotation can be effected in the directions shown by arrows 31, 32 and 33. In this second setting mode the effect layer 24 is directed outwards, i.e. in the directions of arrows 28, 29 and 30. In this setting mode the warhead charges can thus effectively engage a different type of target compared with the type illustrated in FIG. 4. It is realised that other types of effect layers can be employed. When triggered in this setting mode the explosive compositions 23 in warhead charges 20, 21 and 22 produce a combined pressure and pellets effect with the pellets of large dimension.

FIGS. 6 and 7 show a design in which four essentially identical cylindrical warhead charges are arranged parallel to each other in a way similar to the case illustrated in FIG. 4. Each cylindrical warhead charge is constructed in a similar manner to those illustrated in FIGS. 4 and 5 and, consequently, is not described in any further detail herein. The warhead charges 34–36 illustrated in FIGS. 6 and 7 also operate with two setting modes that are realised by an initial setting mode being employed as shown in FIG. 6, while a second setting mode as shown in FIG. 7 is effected by rotational actuation, either manually and/or electrically even in this case. The effect layer with its location of pellets and their respective dimensions is similar to that illustrated in FIGS. 4 and 5.

The design shown in FIGS. 8 and 9 uses an outer circular, tubular warhead charge 38. The main warhead charge 39 is also cylindrical in form and located inside charge 38. The cylindrical main warhead charge 39 is arranged inside the tubular warhead charge 38, and charges 38 and 39 are mutually rotatable in relation to each other. This mutual rotatability can be achieved by enabling charge 38 to rotate in relation to charge 39 or vice versa. In an alternative design both parts could be rotatable to enable the two different mutual rotational or setting modes illustrated in FIGS. 8 and 9. Half the periphery of the tubular charge 38 comprises an effect layer 40 containing pellets of a first (large) dimension. Half the periphery of the main warhead charge 39 comprises an embedded unit 42 of smaller diameter than that of unit 43. An effect layer 44 is thus formed along the embedded unit 42. Effect elements in the form of pellets 45 can be arranged in the said effect layer, which can comprise smaller dimension pellets in relation to those designated 41. Alternatively the same pellet dimension can be used, or the effect layer 44 can comprise pellets of a larger dimension than pellets 41 in effect layer 40. In the setting mode between charges 38 and 39 the effect layers 40 and 44 are directed outwards, i.e. in the directions of arrows 46 and 47, which directions are diametrically opposed. This arrangement enables a 360-degree dispersion of pellet elements 41 and 45 when the main warhead charge 39 is initiated. It should here be noted that FIGS. 8 and 9 only illustrate functions in a general manner and that the tubular charge 38, for example, must display greater wall thicknesses to enable a space to be formed to accommodate effect layer 40.

In the setting mode illustrated in FIG. 9 the tubular charge 38 has been rotated a half revolution in relation to main warhead charge 39, which means that effect layers 41 and 44 are located alongside each other, i.e. both layers directed outwards in the same direction 47. There is thus a layer free of effect elements in the diametrically opposite direction 46. Consequently, in direction 47 the warhead charge when initiated will produce pressure effect combined with the effects from pellets 41 and 45, while in the opposite direction only pressure effect will be produced.

The main warhead charge 39 in one design, shown in cross-section in FIG. 8, can comprise two semi-cylinders with different radii, R and R'. The smaller radius R' of the semi-cylinder provides space to accommodate the second effect layer 44. Loose pellets 45 can be applied in the layer or space 44, and can in principle lie unattached beside each other. The pellets can even be cast in a hard shell. The pellets 45 are thus constrained by the inner surface 38*a* of the tubular charge 38 and the outer surface 39*a* of the semi-cylindrical unit. At the transition between the two semi-cylinders, there are collars 39*b* that close off the space 44 and retain the pellets 45 inside the said space. The arrangement is such that the semi-cylinder with the larger diameter R displays an outer surface 39*c* that is slightly inside the inner surface 38*b* of the tubular charge 38. Main warhead charge 39 is thus journaled inside the said inner surface 38*b* via its outer surface 39*c* and pellets 45. The arrangement is devised thus to enable rotation to be relatively easy. The rotation function in the design illustrated in FIGS. 8 and 9 can be constructed in accordance with the above. This also applies to the journalling function. In FIG. 4, the outer surface or periphery of the cylindrical warhead charge is designated 20*a*. The outer surface or periphery of the tubular warhead charge in FIG. 8 is designated 39*d*. in the designs illustrated in FIGS. 4–7 one effect layer, e.g. effect layer 25, can in principle be omitted and the semi-cylindrical part of the explosive composition can extend out to, or in the proximity of, the periphery 20*a*. In this way, pressure effect alone would be produced in one direction. This also applies to the designs illustrated in FIGS. 6 and 7.

The present invention is not limited to the design examples illustrated above, but can be subjected to modifications within the framework of the subsequent patent claims and the invention concept.

We hereby claim and desire to secure by Letters Patent the following:

1. An ammunition unit, comprising:

a plurality of warhead charges, each warhead charge comprising:

an explosive composition;

at least one effect layer extending around at least a part of a periphery of the explosive composition, wherein the warhead charges are rotatable with respect to one another within the ammunition unit; and a rotation device operatively coupled to at least one of the warhead charges to rotate the at least one warhead charge, wherein the rotation device comprises at least one driver coupled to a gear ring on a warhead charge.

2. The ammunition unit of claim 1, wherein each warhead charge comprises a gear ring and the gear rings of the warhead charges are engaged to provide coordinated rotation of the warhead charges.

3. An ammunition unit, comprising:

a plurality of warhead charges, each warhead charge comprising:

an explosive composition; and at least one effect layer extending around at least a part of a periphery of the explosive composition, wherein the warhead charges are rotatable with respect to one another within the ammunition unit;

wherein in a first setting mode the ammunition unit directs effect layers comprising large pellets or fragments outwards, and in a second setting mode the ammunition unit directs effect layers having small pellets or fragments outwards.

4. An ammunition unit, comprising:

a tubular warhead charge having a first effect layer extending around only a part of a periphery of the tubular warhead charge; and a main warhead charge disposed within the tubular warhead charge and having a second effect layer extending around only a part of the main warhead charge, wherein at least one of the tubular warhead charge and the main warhead charge is mutually rotatable with respect to the other to place the first effect layer and the second effect layer in various relative rotational orientations.

5. The ammunition unit of claim 4, wherein the first and second effect layers can have substantially opposite orientations, and can partially overlap.

6. The ammunition unit of claim 5, wherein the effect layers contain differing effect elements.

7. The ammunition unit of claim 5, wherein the tubular warhead charge has a radius of R and the main warhead charge has a smaller radius of R'.

8. The ammunition unit of claim 5, wherein the tubular warhead charge comprises an annular space containing effect elements.

9. The ammunition unit of claim 5, comprising:

a rotation device operatively coupled to at least one of the warhead charges to rotate the at least one warhead charge.

10. The ammunition unit of claim 9, wherein the main warhead charge is journalled to enable rotation of the main warhead charge.

11. The ammunition unit of claim 9, wherein each effect layer comprises:

effect elements selected from the group consisting of: large pellets, small pellets, fragments, and incendiary agents.

12. The ammunition unit of claim 9, wherein the rotation device is remotely controllable.

13. The ammunition unit of claim 9, wherein the rotation device is manually actuated in conjunction with selection of a target type.

14. The ammunition unit of claim 4, wherein the main warhead charge disposed within the tubular warhead charge comprises a cylindrical warhead charge, wherein:

after the cylindrical warhead charge and the tubular warhead charge are rotated with respect to one another within the ammunition unit, the first effect layer and the second effect layer are arranged, respectively in different first and second orientations with respect to each other, and the first effect layer and the second effect layer comprise different materials which, upon detonation, provide different weapons effects in each of the first and second orientations.

* * * * *